US007349656B2

(12) United States Patent
Katsuyama

(10) Patent No.: US 7,349,656 B2
(45) Date of Patent: Mar. 25, 2008

(54) VOLUME REDUCING APPARATUS AND TONER SUPPLYING APPARATUS USED IN IMAGE FORMING DEVICE

(75) Inventor: Goro Katsuyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 309 days.

(21) Appl. No.: 11/265,183

(22) Filed: Nov. 3, 2005

(65) Prior Publication Data

US 2006/0120762 A1 Jun. 8, 2006

(30) Foreign Application Priority Data

Nov. 9, 2004 (JP) ..... 2004-324509
Oct. 14, 2005 (JP) ..... 2005-299577

(51) Int. Cl.
*G03G 15/08* (2006.01)

(52) U.S. Cl. ..... 399/258

(58) Field of Classification Search ..... 399/258
See application file for complete search history.

(56) References Cited

U.S. PATENT DOCUMENTS 5,322,198 A * 6/1994 Ichikawa ..... 222/321.9
6,304,739 B1 10/2001 Katsuyama, et al.
6,507,720 B2 1/2003 Kabumoto, et al.
6,519,436 B2 2/2003 Katsuyama
6,532,352 B2 3/2003 Katsuyama
6,549,744 B2 4/2003 Terazawa, et al.
6,647,236 B2 11/2003 Katsuyama
6,648,218 B2 11/2003 Katsuyama, et al.
6,771,921 B2 8/2004 Katsuyama
2004/0131392 A1 7/2004 Matsumoto, et al.
2006/0120762 A1 6/2006 Katsuyama (Continued)

FOREIGN PATENT DOCUMENTS

JP 2004-117417 4/2004

OTHER PUBLICATIONS

U.S. Appl. No. 11/113,174, filed Apr. 25, 2005, Goro Katsuyama, et al.

*Primary Examiner*—David M. Gray
*Assistant Examiner*—Ryan D. Walsh
(74) *Attorney, Agent, or Firm*—Oblon, Spivak, McClelland, Maier & Neustadt, P.C.

(57) ABSTRACT

A volume reducing apparatus that is capable of eliminating wastage of an item to be housed and is capable of reducing the volume of a storage portion with a simple structure and without dirtying the hands of a user by the item to be housed, and a toner supplying apparatus that uses this volume reducing apparatus, which comprise a housing portion in which toner is housed; a shutter member; a cylinder linked to the housing portion; a piston freely movable inside the cylinder; and an air supply opening of a pump (medium discharge portion) that links to the cylinder and discharges air into the cylinder; wherein a toner discharge opening (opening portion) is formed at the housing portion, a linking hole is formed at the cylinder, and the piston has an air hole that links to the linking hole at another end side inside the cylinder, and the piston moves from one end side to the other end side inside the cylinder when air is discharged from the air supply opening into the cylinder such that the air hole of the piston and the linking hole of the cylinder link and air is discharged into the housing portion and the toner discharge opening is closed by the shutter member.

12 Claims, 11 Drawing Sheets

U.S. PATENT DOCUMENTS

2007/0122205 A1 5/2007 Taguchi, et al.
2007/0147900 A1 6/2007 Taguchi, et al.
2007/0147902 A1 6/2007 Taguchi, et al.
2007/0154224 A1 7/2007 Taguchi et al.
2007/0154243 A1 7/2007 Taguchi, et al.
2007/0160393 A1 7/2007 Taguchi et al.
2007/0160394 A1 7/2007 Taguchi, et al.
2007/0177886 A1 8/2007 Taguchi, et al.

* cited by examiner

VOLUME REDUCING APPARATUS AND TONER SUPPLYING APPARATUS USED IN IMAGE FORMING DEVICE

BACKGROUND OF THE INVENTION

1. Field of the Invention

The present invention relates to an image forming device such as a printer, facsimile device, or copying machine, and more particularly relates to a volume reducing apparatus that enables volume reduction of a toner storage container that has become empty, and to a toner supplying apparatus that are used in such an image forming device.

2. Description of the Background Art

Conventionally, devices using a developer vessel in which toner is stored are known as a type of image forming device. For example, in Japanese Patent Application Laid-open No. 2004-117417, a technique is disclosed in which a storage portion for storing toner (item to be housed) is provided, whereby the toner in the storage portion is supplied to the developer vessel from a toner discharge opening (opening portion). When all the toner in the storage portion is gone, the storage portion is detached from the main structure of the device and discarded.

However, with this conventional technique, since a storage portion that has become empty maintains the same bulkiness as when it was full, there is a problem that space is wasted when the storage container is discarded as it is and the efficiency of recovery is reduced. On the other hand, it is conceivable that the storage portion can be reduced in volume before being discarded, but there is a problem that a user's hands or clothing will be soiled by toner remaining in the storage portion and toner adhering to the periphery of the discharge opening. Moreover, even a storage portion that has become empty often has toner remaining that is adhering to inner walls or other areas inside the storage portion, and from the point of view eliminating toner wastage it is preferable that such remaining toner is dropped from the toner discharge opening into the developer vessel before the storage portion is discarded.

SUMMARY OF THE INVENTION

An object of the present invention is to provide a volume reducing apparatus that is capable of eliminating wastage of an item to be housed and is capable of reducing the volume of a storage portion with a simple structure and without dirtying the hands of a user by the item to be housed, a toner supplying apparatus that uses this, and an image forming device equipped with these.

In accordance with an aspect of the present invention, a volume reducing apparatus comprises a housing portion in which an item to be housed is housed; a shutter member; a cylinder linked to the housing portion; a piston freely movable inside the cylinder; and a medium discharge portion that links to the cylinder and discharges a medium into the cylinder. An opening portion that links to the outside is formed at the housing portion, a linking hole that links inside the cylinder and the opening portion is formed at the cylinder, and the piston has an air hole that links to the linking hole at another end side inside the cylinder, and the piston moves from one end side to the other end side inside the cylinder when a medium is discharged from the medium discharge portion into the cylinder such that the air hole of the piston and the linking hole of the cylinder link and the medium is discharged into the housing portion and the opening portion of the housing portion is closed by the shutter member.

In accordance with another aspect of the present invention, a volume reducing apparatus comprises a housing portion in which an item to be housed is housed; a shutter member; a cylinder linked to the housing portion; a piston freely movable inside the cylinder; and a medium suction portion that links to the cylinder and suctions a medium inside the cylinder. An opening portion that links to the outside is formed at the housing portion, a linking hole that links inside the cylinder and the opening portion is formed at the cylinder, and the piston has an air hole that links to the linking hole at another end side inside the cylinder, and the piston moves from the other end side to one end side inside the cylinder when a medium inside the cylinder is suctioned via the medium suction portion such that a linkage between the linking hole of the cylinder and the air hole of the piston closes and the shutter member moves such that the opening portion of the housing portion opens.

In accordance with the another aspect of the present invention, a volume reducing apparatus comprises a housing portion in which an item to be housed is housed; a shutter member; a cylinder linked to the housing portion; a piston freely movable inside the cylinder; a medium discharge portion that links to the cylinder and discharges a medium into the cylinder; and a medium suction portion that links to the cylinder and suctions a medium inside the cylinder. An opening portion that links to the outside is formed at the housing portion, a linking hole that links inside the cylinder and the opening portion is formed at the cylinder, and the piston has an air hole that links to the linking hole at another end side inside the cylinder, and the piston moves to the other end side inside the cylinder when a medium is discharged from the medium discharge portion into the cylinder such that the air hole of the piston and the linking hole of the cylinder link and the medium is discharged into the housing portion and the opening portion of the housing portion is closed by the shutter member, and the piston moves from the other end side to one end side inside the cylinder when a medium inside the cylinder is suctioned via the medium suction portion such that a linkage between the linking hole of the cylinder and the air hole of the piston closes and the shutter member moves such that the opening portion of the housing portion opens.

In accordance with another aspect of the present invention, a toner supplying apparatus comprises a storage container for storing toner; a tray fastened to the storage container; a suction device for suctioning air within the storage container; and a shutter member. The storage container has a toner discharge opening for discharging toner. A toner inflow opening for allowing toner to flow into a developer vessel is provided in the tray. The shutter member carries out opening and closing of the toner inflow opening. When volume reduction of the storage container is carried out, the toner inflow opening is closed by the shutter member and air within the storage container is suctioned from the toner discharge opening by the suction device.

BRIEF DESCRIPTION OF THE DRAWINGS

The above and other objects, features and advantages of the present invention will become more apparent from the following detailed description taken with the companying drawings in which.

DESCRIPTION OF THE PREFERRED EMBODIMENTS

The following is a detailed description of a first embodiment of the present invention with reference to the accompanying drawings.

Figure 4:
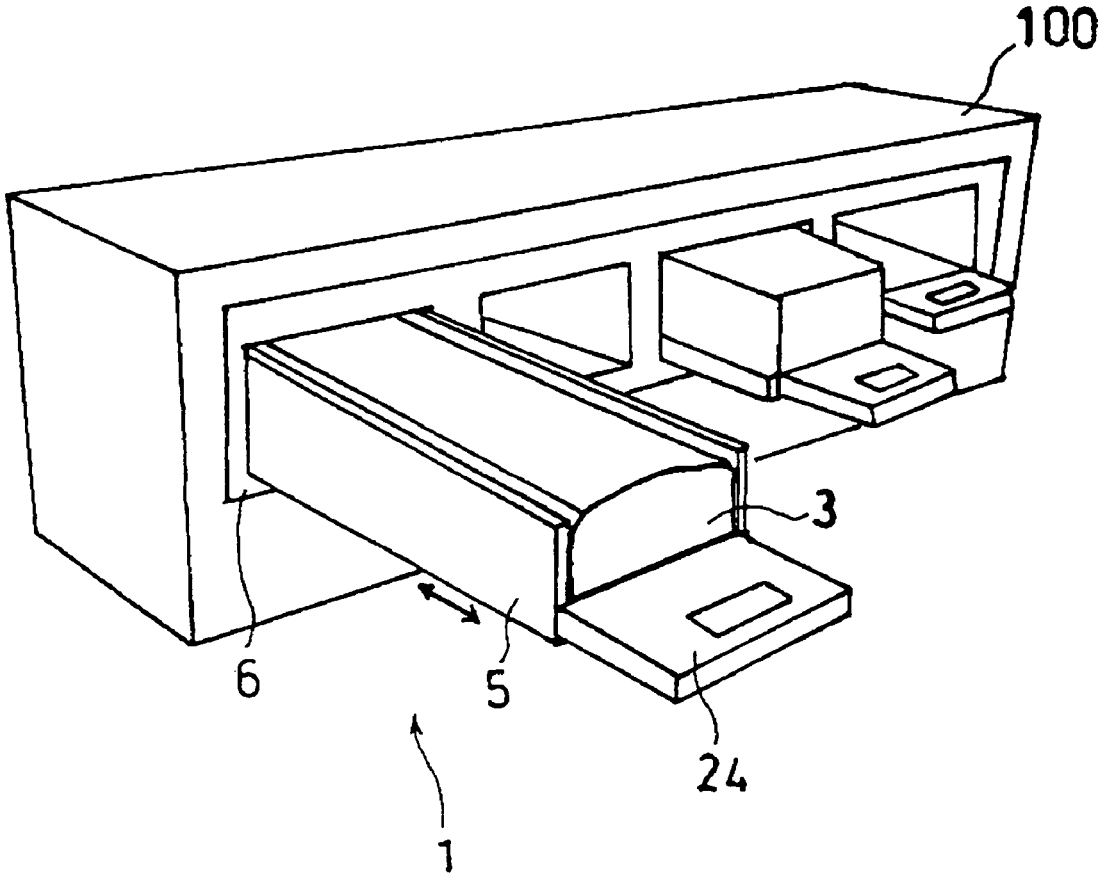
FIG. 4 is an oblique view showing a portions of an image forming device, in which the toner supplying apparatus is housed, that have been pulled out.

As shown in FIG. 4, a toner supplying apparatus (volume reducing apparatus) 1 according to the present embodiment is provided inside an image forming device 100 such an a color copying machine and is provided with a storage container 3 for toner (item to be housed), a housing portion constituted by a tray 5 that fastens the storage container 3, and suction means 4 (see FIG. 1) for suctioning air (a medium) inside the storage container 3.

Figure 1:
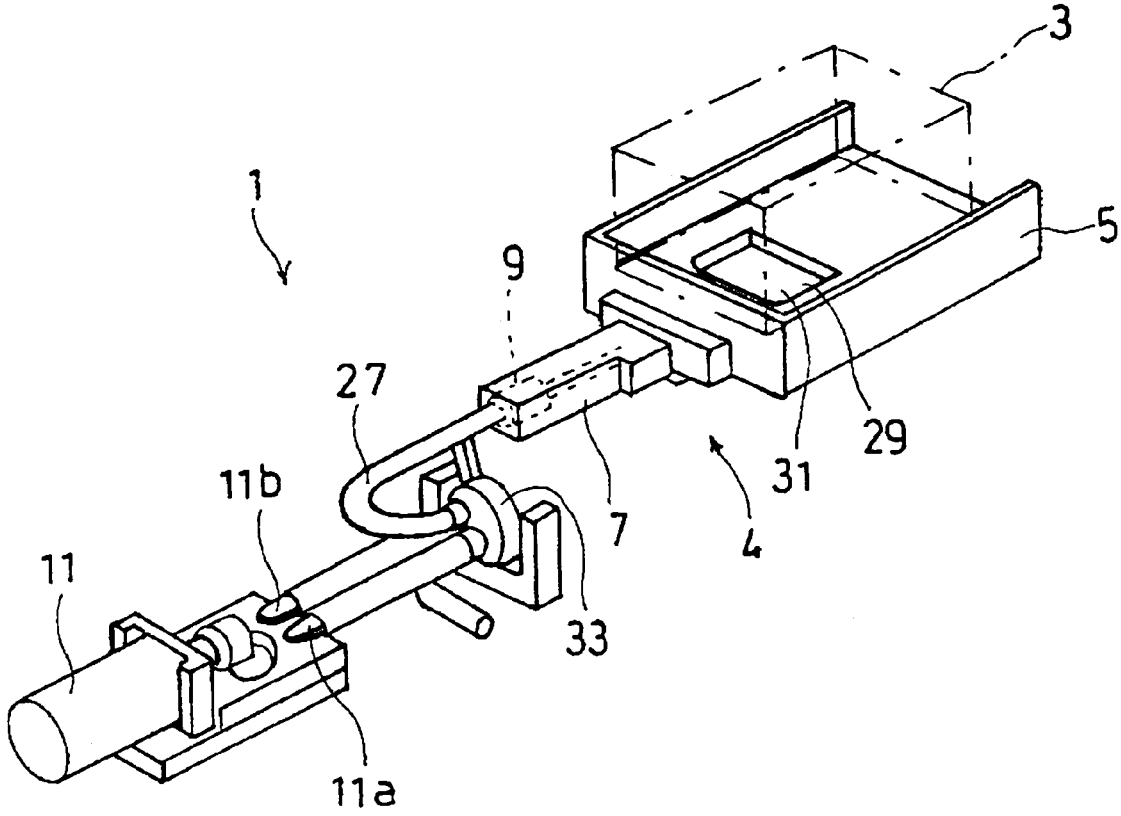
FIG. 1 is an oblique view showing an overall structure of a toner supplying apparatus according to a first embodiment of the present invention.
Figure 2:
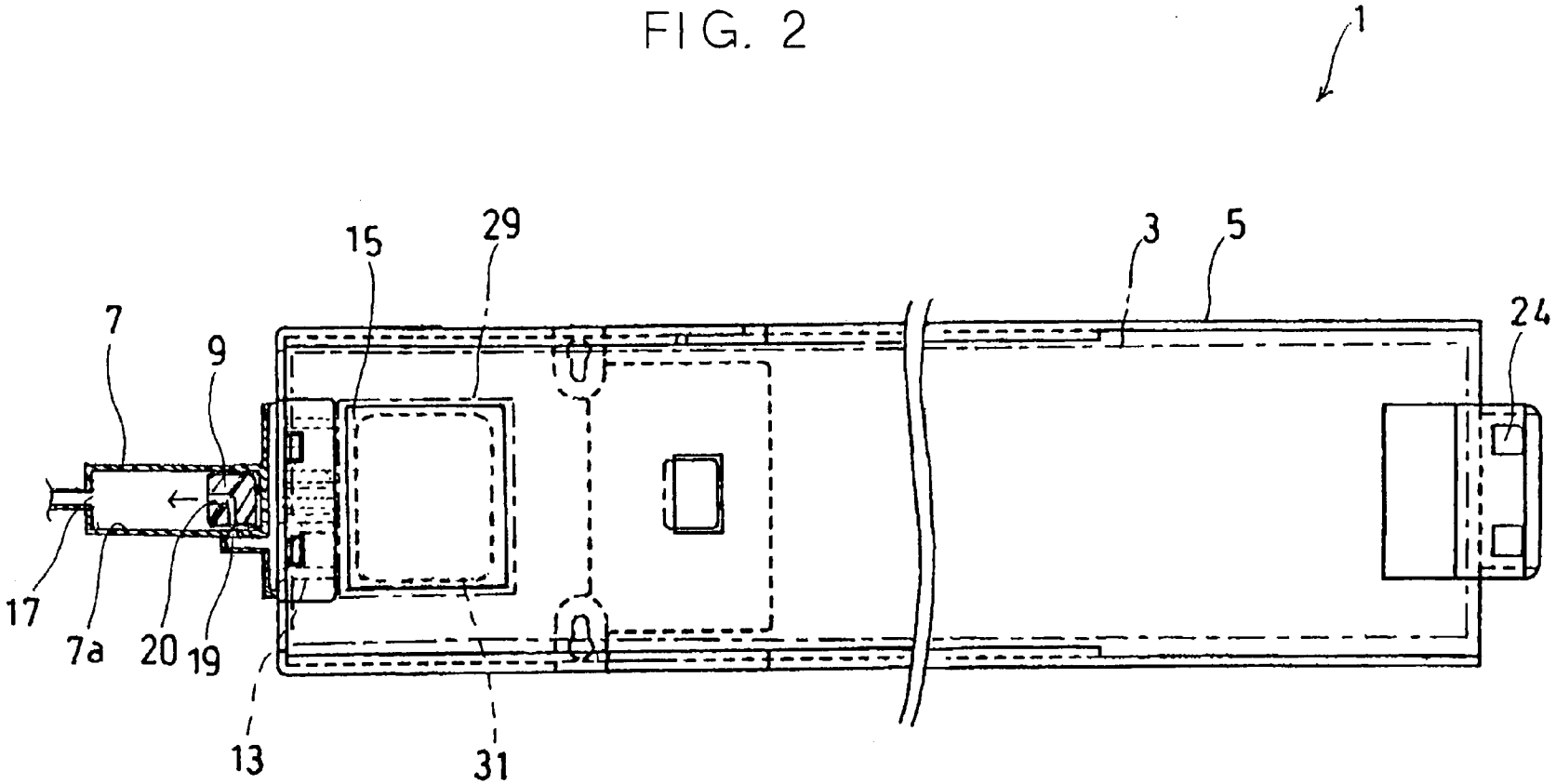
FIG. 2 is a transverse cross sectional view of the toner supplying apparatus.
Figure 3:
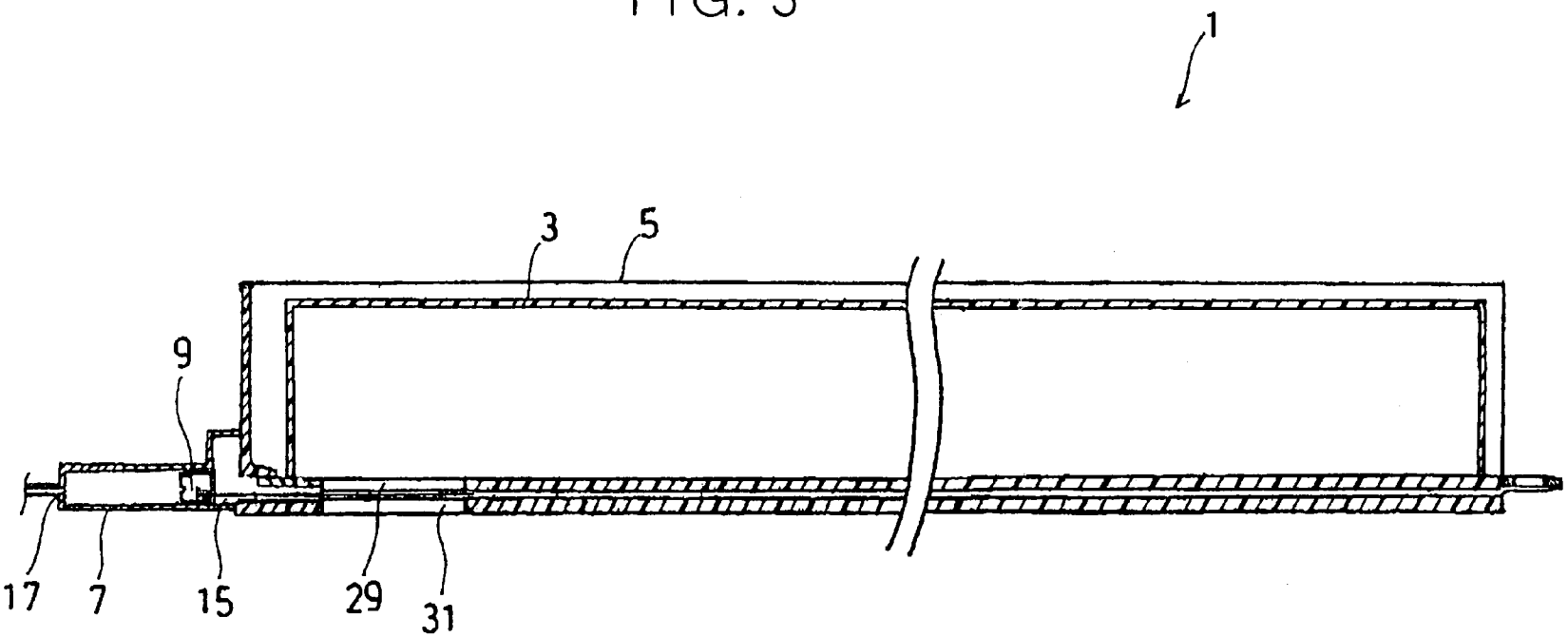
FIG. 3 is a longitudinal cross sectional view of the toner supplying apparatus.
Figure 5:
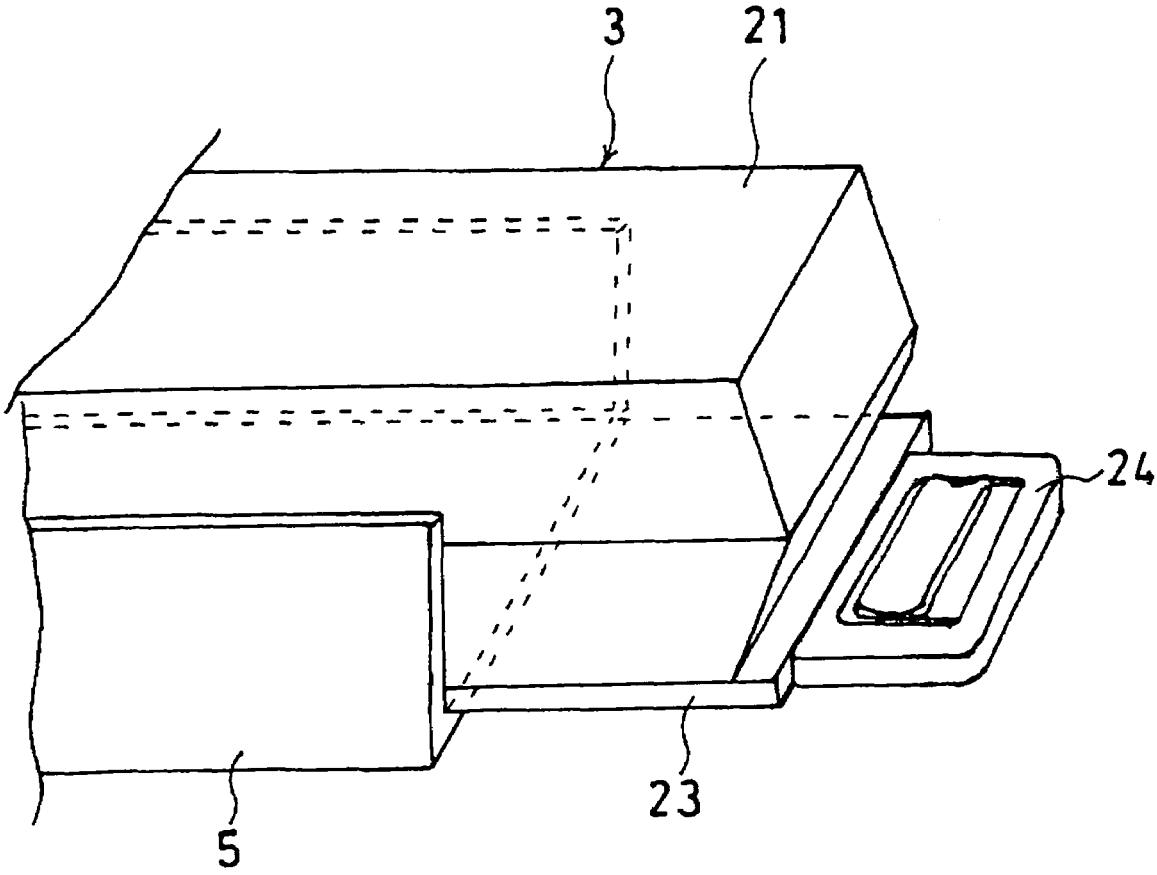
FIG. 5 is an oblique view showing a portion of the storage container of the toner supplying apparatus.

As shown in FIGS. 4 and 5, the storage container 3 is provided with a container body 21 for storing toner, and a hard board 23 that is fixed to a bottom surface of the container body 21. The storage container 3 is provided with a handle 24 that enables the storage container 3 to be stored in and removed from the tray 5. The container body 21 is a transparent material made from vinyl chloride. The container body 21 is configured to expand to a substantial prismatic shape when the container body 21 is filled with toner. The container body 21 is configured to deform and crumple flat when it has become empty of toner and air is suctioned out of it. As shown in FIGS. 1 to 3, a toner discharge opening (opening portion) 29 is formed at one end of the storage container 3 so that toner inside the container can be discharged from the toner discharge opening 29 to the developer vessel.

The tray 5 is a box shape in which an upper portion and a front end portion are open and, as shown in FIG. 4, is provided so as to be freely moved in and out of a housing portion 6. The storage container 3 is configured such that it can be fastened in the tray 5 while the tray 5 is removed from the housing portion 6. Furthermore, a toner inflow opening 31 is provided in the tray 5 so that toner can flow into the developer vessel and toner that has passed through the toner discharge opening 29 of the storage container 3 flows into the developer vessel through the toner inflow opening 31. As shown in FIG. 2, a plurality of suction holes 13 that link a cylinder 7 and the storage container 3 are formed at the toner discharge opening end of the tray 5. One end of the suction holes 13 opens to an outer wall surface at a rear end portion of the tray 5 and the other end opens to the inside of the storage container.

The suction means 4 is provided with the cylinder 7 that connects to the storage container 3, a piston 9 that moves freely in contact inside the cylinder 7, and a pump 11 that suctions air inside the cylinder 7.

The cylinder 7 is fixed to the rear end side of the tray 5. A tube connecting opening 17 is formed at an end portion at one end of the cylinder 7 and a linking hole 19 that links to the inside of the storage container 3 are formed at an end portion at the other end of the cylinder 7.

A shutter member 15 for opening and closing the toner inflow opening 31 of the tray 5 is attached to the piston 9 and the shutter member 15 is configured to move linked with the piston 9. Furthermore, an air hole 20 one end of which opens toward the inside of the cylinder 7 and the other end of which slides in contact with a side surface 7*a* inside the cylinder is formed in the piston 9, such that when the piston 9 is positioned at the other end side of the cylinder 7, the air hole 20 of the piston 9 and the linking hole 19 of the cylinder 7 act as a vent.

The pump 11 is provided with an air supply opening (medium discharge portion) 11*a* and a discharge opening (medium suction portion) 11*b*. The pump 11 and the cylinder 7 are connected through a connecting tube 27. Furthermore, a switching valve (switching device) 33 is provided between the pump 11 and the cylinder 7. The cylinder 7 links with the air supply opening 11*a* or the discharge opening 11*b* due to the switching of the switching valve 33.

As shown in FIGS. 6 and 7A to 7D, position detection sensors 35 are provided to detect the presence and absence of the piston 9 at a side surface of one end and a side surface of the other end of the cylinder 7. When a detection sensor 35*a* provided at the side surface of the other end of the cylinder 7 detects the piston 9, the switching valve 33 switches such that the cylinder 7 connects to the discharge opening 11*b* and the air inside the cylinder is suctioned. On the other hand, when a detection sensor 35*b* at the side surface of one end of the cylinder 7 detects the piston 9, the driving of the pump 11 is stopped.

Figure 6:
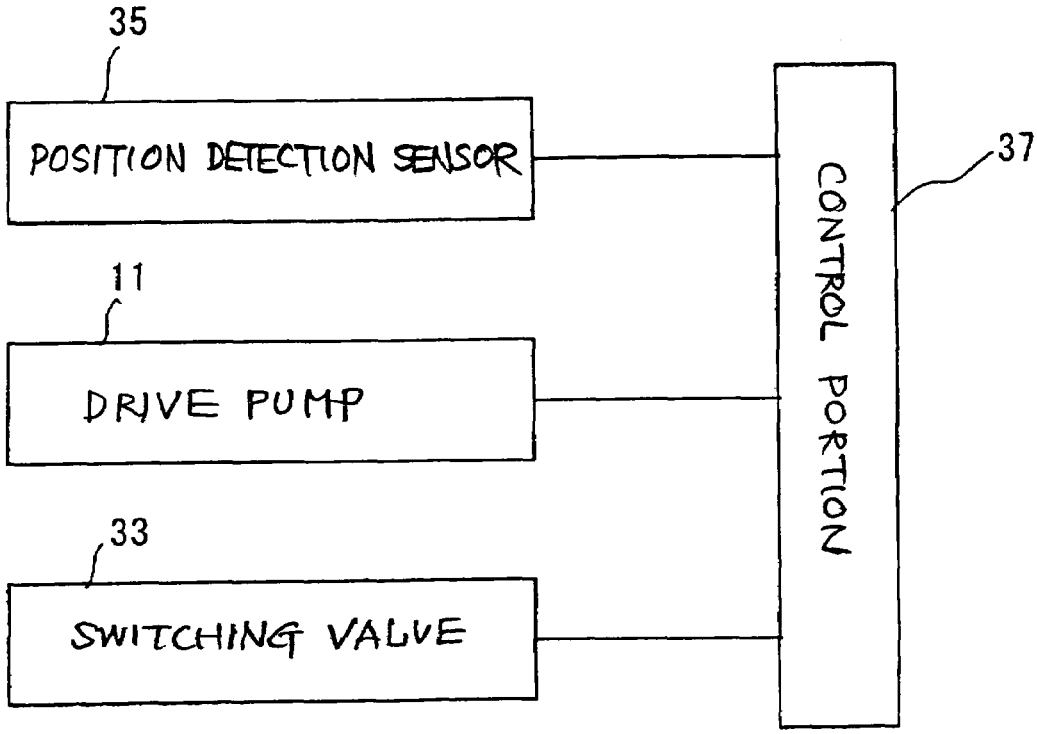
FIG. 6 is a block diagram showing a configuration of a control system of a toner supplying apparatus.

The position detection sensors 35, the pump 11, and the switching valve 33 are respectively connected to a control portion 37 (see FIG. 6). The control portion 37 receives detection signals from the position detection sensors 35 and carries out drive control for the pump 11 and switching control for the switching valve 33.

Next, a mode of operation and an effect of the present embodiment are described using FIG. 7.

Figure 7A:
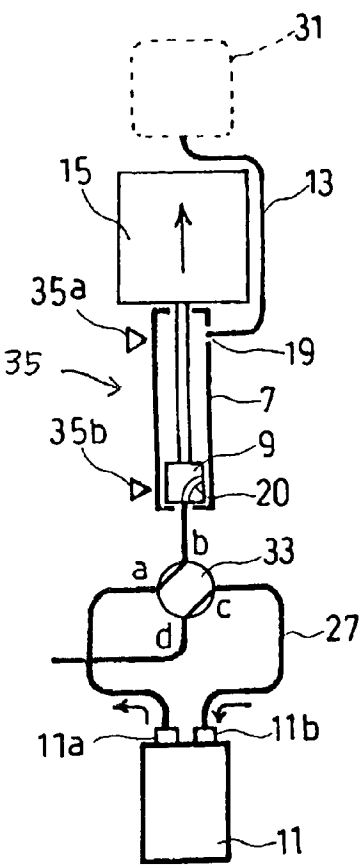
FIG. 7A is a schematic drawing showing a condition before air is sent into the cylinder in a driving operation of the toner supplying apparatus.
Figure 7B:
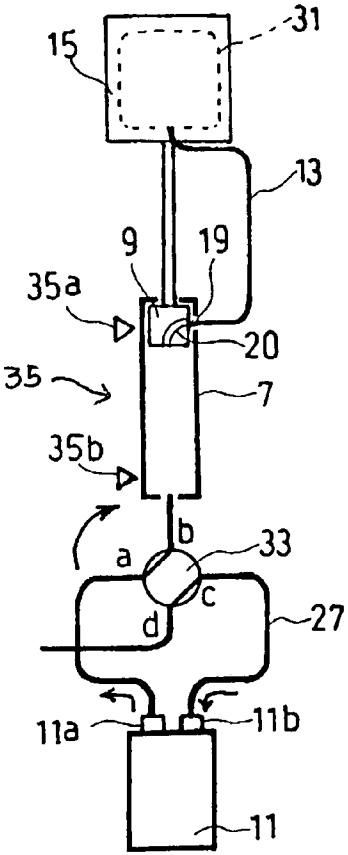
FIG. 7B is a schematic drawing showing a condition in which a toner inflow opening is closed by a shutter member by air sent into the cylinder.
Figure 7C:
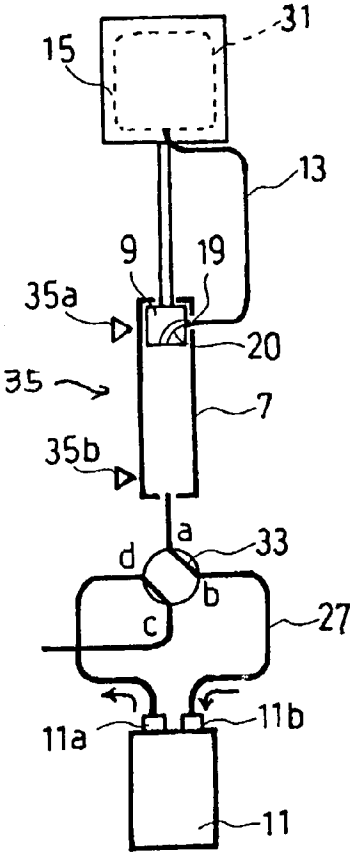
FIG. 7C is a schematic drawing showing a condition in which a switching valve has switched and air inside the storage container is being suctioned.
Figure 7D:
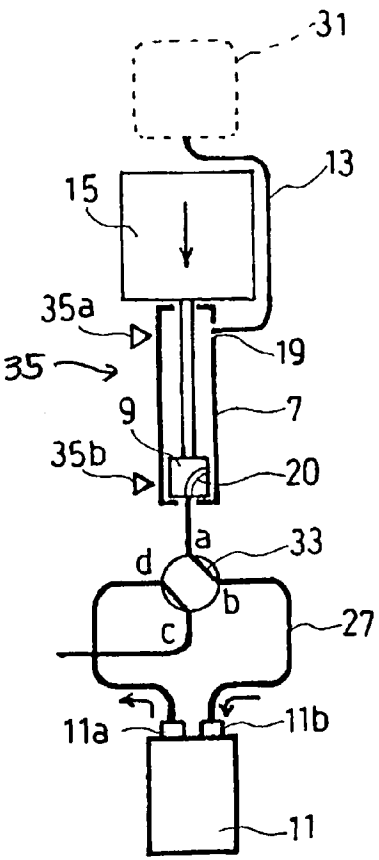
FIG. 7D is a schematic drawing showing a condition in which the shutter member has returned to open the toner inflow opening.

When the storage container 3 becomes empty of toner, the pump 11 begins to drive and air is sent (FIG. 7A) into the cylinder 7 from the air supply opening 11*a*. When air is sent into the cylinder 7, the piston 9 is pushed from one end side to another end side and along with this the shutter member 15 that is linked to the piston 9 moves so as to close the toner inflow opening 31. At this time, the air hole 20 of the piston 9 links with the linking hole 19 of the cylinder 7 and air is discharged into the storage container 3 (FIG. 7B). Following this, the detection sensor 35*a* provided at a side surface of the other end of the cylinder 7 detects the piston 9 and sends a detection signal to the control portion 37 so that the cylinder 7 and the discharge opening 11*b* of the pump 11 are linked due to the switching control of the switching valve 33. Then, the air inside the storage container 3 is suctioned through the air hole 20 of the piston 9 due to the air inside the cylinder 7 being suctioned and the storage container 3 reduces in volume (FIG. 7C). After the storage container 3 has been reduced in volume and air is further suctioned from the cylinder 7, the inside of the cylinder 7 is decompressed and the piston 9 returns from the other end side to the one end side, and at the same time the shutter member 15 moves so that the toner inflow opening 31 opens. When the piston 9 returns to the one end side of the cylinder 7, the detection sensor 35*b* provided at a side surface of the one end side of the cylinder 7 detects the piston 9 and a detection signal is sent to the control portion 37 so that the driving of the pump 11 stops (FIG. 7D). After this, the storage container 3 is removed from the tray 5 and the storage container 3 is disposed of in a volume-reduced condition.

In the present embodiment, since the air inside the storage container 3 is suctioned from the toner discharge opening 29 by the suction means 4 when the storage container 3 becomes empty of toner, the bulkiness of the storage container 3 can be easily reduced by decompression within the storage container 3, thereby enabling the empty storage container 3 to be automatically reduced in volume without soiling the user's hands or clothes while the storage container 3 is loaded in the tray 5.

Furthermore, since the air hole 20 of the piston 9 and the linking hole 19 of the cylinder 7 link when the toner inflow opening 31 is closed by the shutter member 15, volume reduction of the container and closing of the passage way can be carried out by the same structure, thereby achieving device simplification by using a common drive source.

And since the cylinder 7 can be alternately connected to the air supply opening 11*a* and the discharge opening 11*b* of the pump 11 by the switching of the switching valve 33, suction and discharge can be achieved with a single pump, thereby keeping down the number of pumps 11.

Furthermore, since the switching valve 33 switches and connects the cylinder 7 to the discharge opening 11*b* when the detection sensor 35*a* at a side surface of an end side of the cylinder 7 detects the piston 9, the determination for the switching operation of the valve can be automated. Moreover, since the driving of the pump 11 stops when each of the detection sensors 35 detects the piston 9, the driving time of the pump 11 can be kept down to a minimum.

Furthermore, since the air hole 20 of the piston 9 and the linking hole 19 of the cylinder 7 link to discharge air from inside the storage container 3 when the shutter member 15 moves and closes the toner inflow opening 31, toner that has adhered to the inside wall of the storage container 3 is scraped off due to a convection current of the air discharged from the storage container 3 so that toner can be supplied to the developer below the storage container 3, thereby eliminating toner waste.

The following is a description of a second embodiment, but the same reference symbols are used for portions that have the same operational effect as portions in the above description and detailed description of those portions is omitted such that the following description includes mainly points of difference from the first embodiment.

Figure 8:
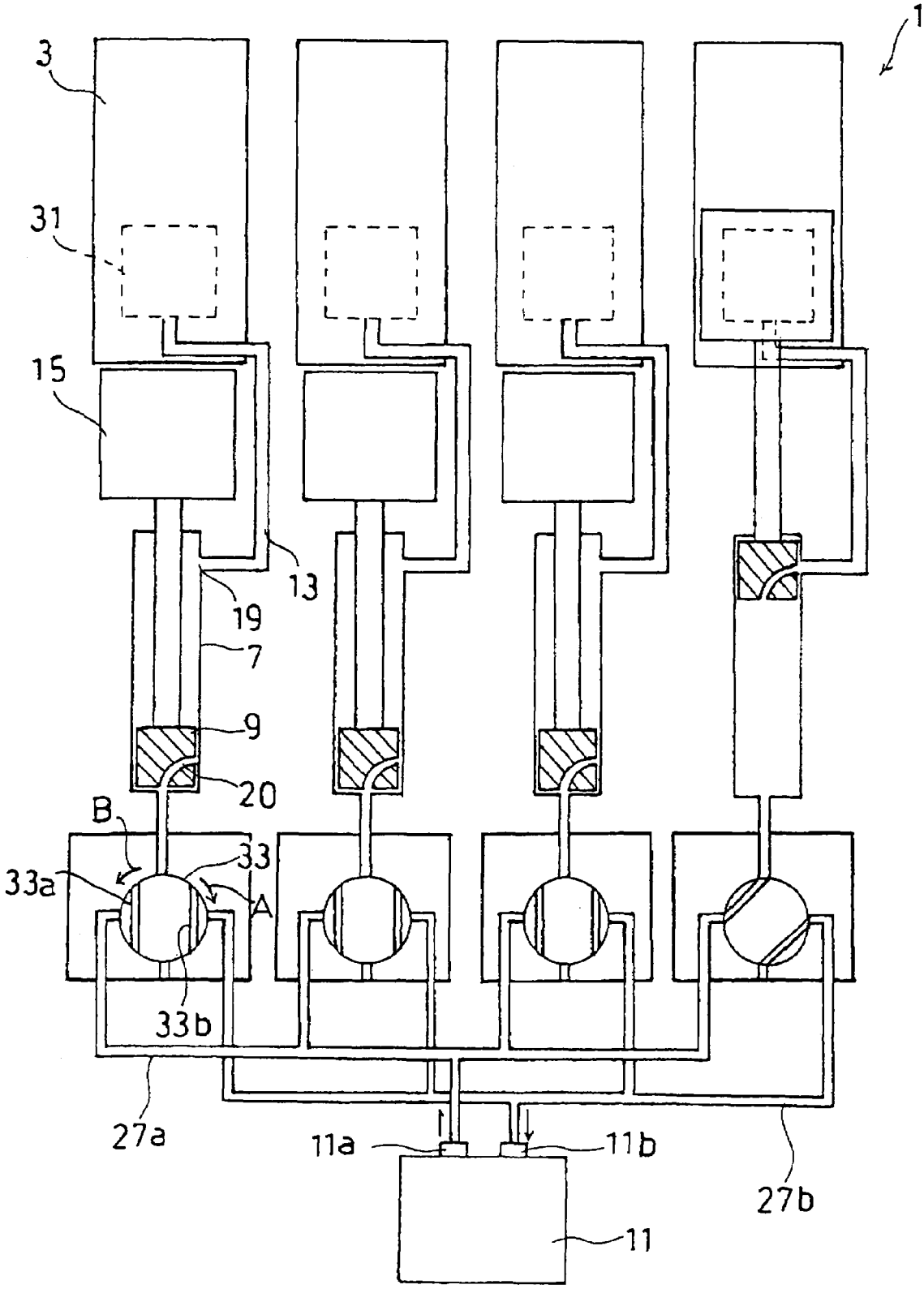
FIG. 8 shows an outline structure of a toner supplying apparatus according to a second embodiment of the present invention.

As shown in FIG. 8, the second embodiment is provided with a plurality of storage containers 3 whereby the volume of the storage containers 3 is reduced using a single pump 11. As shown in FIG. 8, a cylinder 7, piston 9, and a shutter member 15 are provided respectively for each of the storage containers 3, and a switching valve 33 is provided respectively for each of the cylinders 7. The switching valve 33 can rotate left and right in increments of 45 degrees and linking with the pump 11 and the cylinder 7 can be switched on and off by this switching.

That is, a medium discharge passageway 33*a* constituting a passageway for air discharged from the air supply opening 11*a* of the pump 11 into the cylinder 7 and a medium suction passageway 33*b* constituting a passageway for air suctioned from inside the cylinder 7 to the discharge opening 11*b* of the pump 11 are formed at the switching valve 33, and when the switching valve 33 switches to one direction (direction "A" shown in FIG. 8), the medium discharge passageway 33*a* and the air supply opening 11*a* as well as the medium discharge passageway 33*a* and the cylinder 7 are respectively linked so that air is discharged from the air supply opening 11*a* into the cylinder 7. When the switching valve 33 switches to the other direction (direction "B" shown in FIG. 8), the medium suction passageway 33*b* and the discharge opening 11*b* as well as the medium suction passageway 33*b* and the cylinder 7 are respectively linked so that air inside the cylinder 7 is suctioned to the discharge opening 11*b*.

On the other hand, headers (linking members) 27*a* and 27*b* are provided for the air supply opening 11*a* and the discharge opening 11*b* of the pump 11, with the header 27*a* provided for the air supply opening 11*a* of the pump 11 connecting to each of the switching valves 33 and the header 27*b* provided for the discharge opening 11*b* of the pump 11 connecting to each of the switching valves 33.

As shown in FIG. 8, the storage container 3 for which volume reduction is to be carried out is set so that the pump 11 and the cylinder 7 are linked by a switching of the switching valve 33 to suction out air within the storage container 3, and the other storage containers 3 for which volume reduction will not be carried out are set so that the pump 11 and the cylinders 7 do not link due to a switching of the switching valve 33. In this way, volume reduction can be achieved for a plurality of storage containers 3 by providing the headers 27*a* and 27*b* at the pump 11 and connecting the headers 27*a* and 27*b* to each of the switching valves 33. Furthermore, since the links between the pump 11 and the cylinders 7 can be turned on and off by the switching valves 33, it is possible to achieve volume reduction for a plurality of storage containers 3 by sharing a single pump 11.

Figure 9:
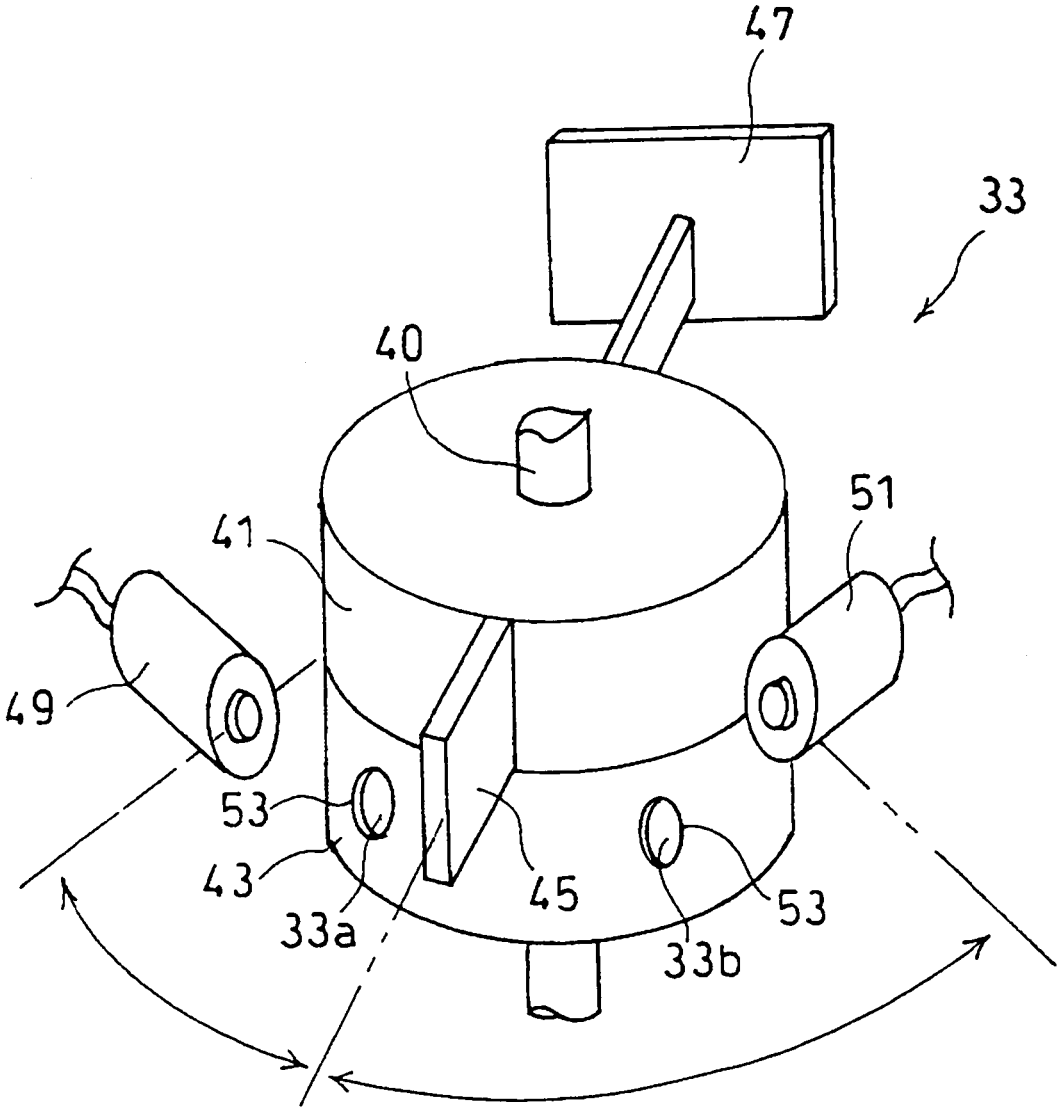
FIG. 9 is an oblique view showing a magnification of the switching valves shown in FIG. 8.
Figure 10:
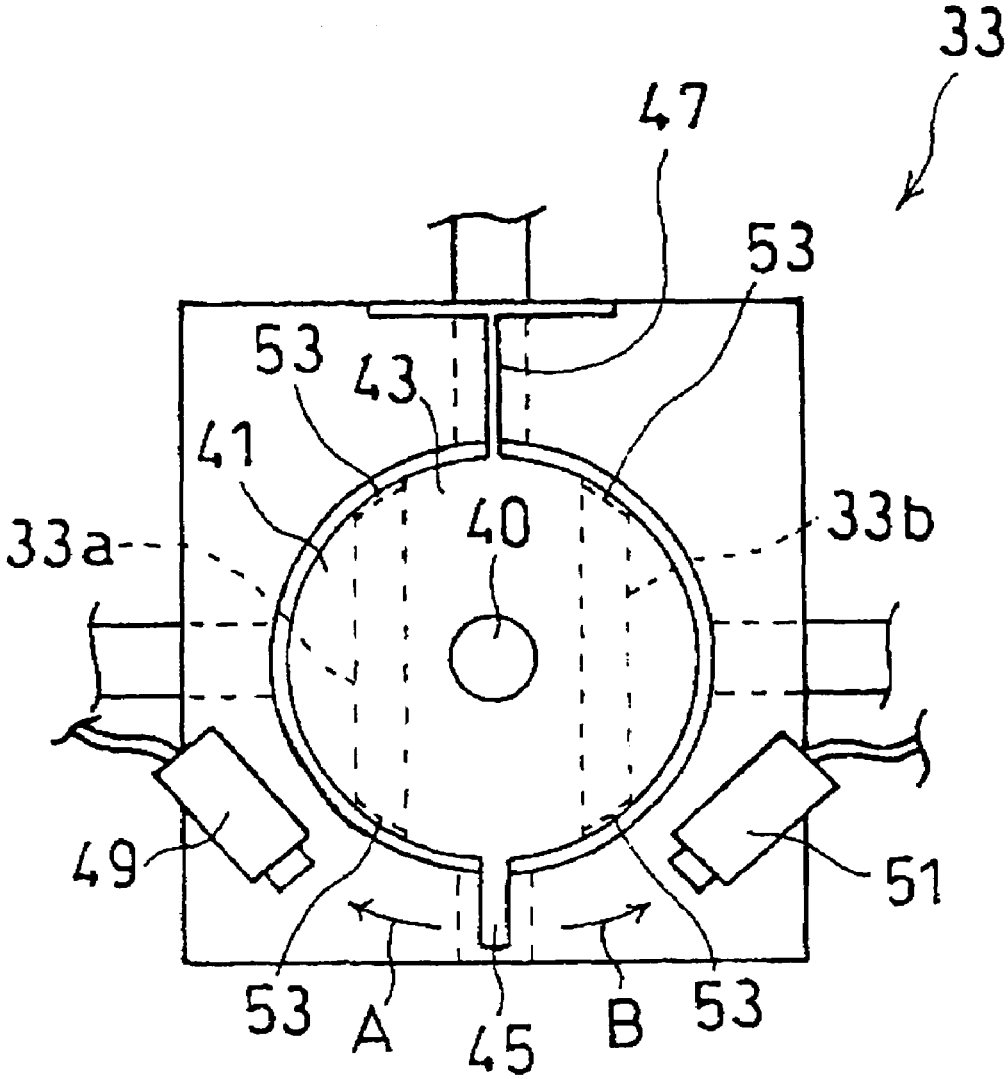
FIG. 10 is a top view showing a structure of the switching valve.
Figure 11:
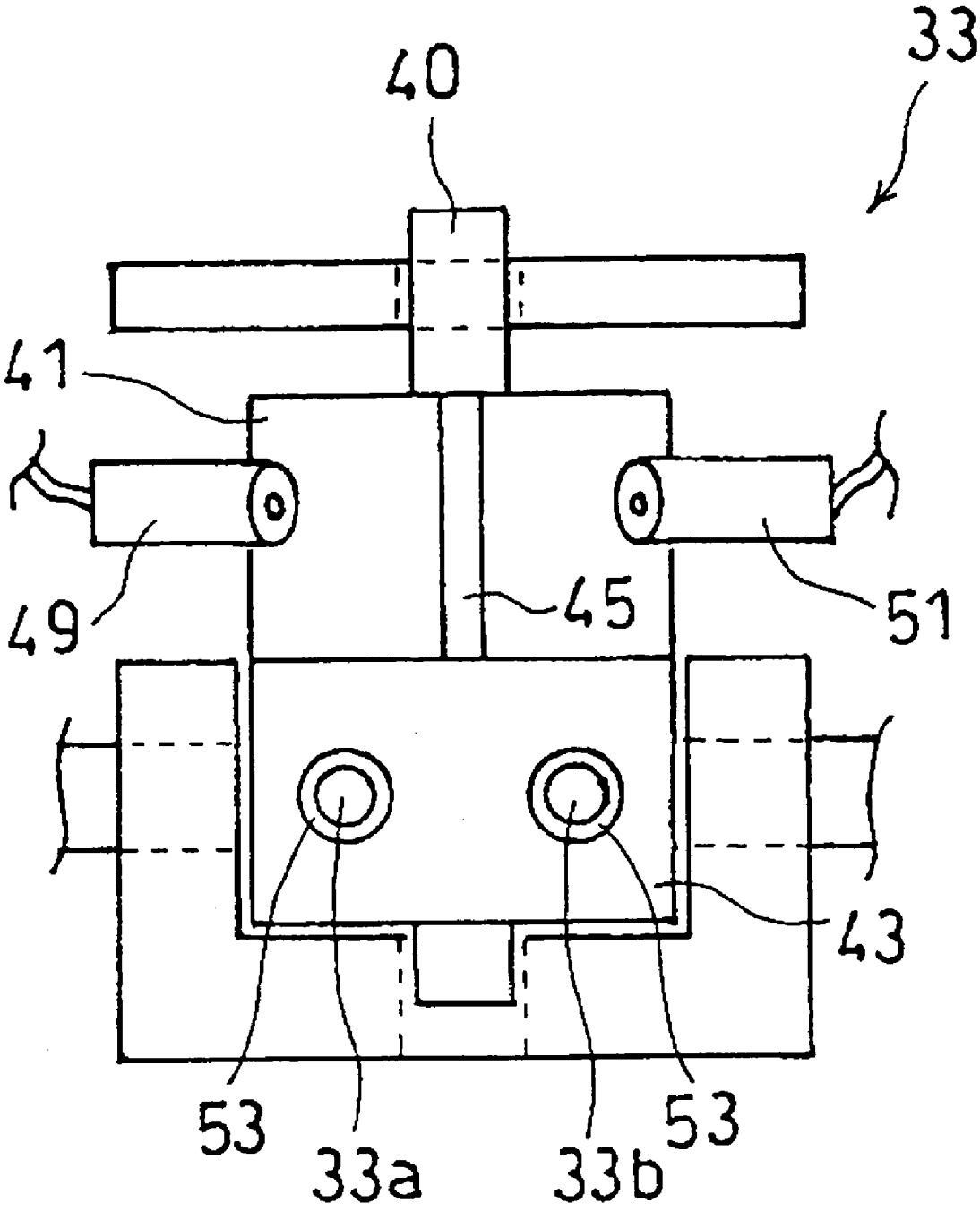
FIG. 11 is a longitudinal cross sectional view of the switching valve.

The following is a description concerning a detailed structure of the switching valve 33. It should be noted that FIG. 9 is an oblique view showing a magnification of the switching valves shown in FIG. 8, FIG. 10 is a top view of the switching valve shown in FIG. 9, and FIG. 11 is a longitudinal cross sectional view of the switching valve shown in FIG. 9.

The switching valve 33 is a cylindrical rotational structure that rotates around an axis 40 as a center and is formed having two levels, namely an upper level upper cylinder portion 41 and a lower level lower cylinder portion 43. Provided at the upper cylinder portion 41 are a magnetic member 45 that protrudes outward from an outer periphery side surface and a plate spring (elastic member) 47 having a biasing force in a rotation direction of the axis 40. The aforementioned medium discharge passageway 33*a* and the medium suction passageway 33*b* are formed in the lower cylinder portion 43. O-rings 53 are provided for the respective inlet and outlet of the medium discharge passageway 33*a* and the medium suction passageway 33*b*, thereby preventing leakage of the air that is discharged from the pump 11 into the cylinder 7 as well as the air that is suctioned from within the cylinder 7 to the pump 11.

Furthermore, provided in respective opposing positions sandwiching the magnetic member 45 are an electromagnet 49 on one side and an electromagnet 51 on another side that produce magnetic force using electricity. When there is no electric current flowing in the electromagnet 49 on one side and the electromagnet 51 on the other side, the switching valve 33 is in a predetermined position (the position shown in FIG. 10) and the linking between the pump 11 and the cylinder 7 is turned off. When an electric current is supplied to the electromagnet 49 on one side, the magnetic member 45 is attracted to the electromagnet 49 on one side and the switching valve 33 rotates 45 degrees in the direction shown by "A" in FIG. 10 such that the medium discharge passageway 33*a* and the air supply opening 11*a* as well as the medium discharge passageway 33*a* and the cylinder 7 respectively link and air is discharged from the air supply opening 11*a* into the cylinder 7. When an electric current is supplied to the electromagnet 51 on the other side, the magnetic member 45 is attracted to the electromagnet 51 on the other side and the switching valve 33 rotates 45 degrees in the direction shown by "B" in FIG. 10 such that the medium suction passageway 33*b* and the discharge opening 11*b* as well as the medium suction passageway 33*b* and the cylinder 7 respectively link and air inside the cylinder 7 is suctioned to the discharge opening 11*b*.

In this way, the switching valves 33 can be switched by turning on and off electric currents to the electromagnets 49 and 51, and therefore switching of the switching valves 33 can be achieved automatically such that operational control of volume reduction is made easy.

It should be noted that in the first embodiment of the present invention, the switching timing of the switching valve 33 and the timing for stopping the driving of the pump 11 were performed using the detection sensors 35, but there is no limitation to this. The time from the commencement of driving of the pump 11 until the switching of the switching valve 33 may be set in advance so that the switching valves 33 switch with the set timing. In regard to the timing for stopping the driving of the pump 11, the time from the commencement of driving of the pump 11 until the stopping of the driving of the pump 11 may be set in advance so that the driving of the pump 11 is stopped with the set timing.

Furthermore, the aforementioned embodiment was described concerning a color copying machine in which four toner supplying apparatuses 1 were incorporated in an image forming device 100, but there is no limitation to this and the toner supplying apparatus 1 may be incorporated in a monochrome copying machine.

Furthermore, toner was used as the item to be housed in the aforementioned embodiment, but there is no limitation to this and a developing agent or an ink may be housed.

As described above, with the present invention, when the medium is discharged from the medium discharge portion into the cylinder, the piston moves inside the cylinder such that the air hole of the piston and the linking hole of the cylinder become linked, and the medium inside the housing portion discharges, and therefore the item being housed that adheres inside the housing portion can be scraped off by the discharging force of the medium discharged inside the housing portion, thereby eliminating waste of the item being housed. Furthermore, since an opening portion of the housing portion is closed by the shutter member linked to movement of the piston, the volume of the housing portion can be reduced using a simple structure and without soiling the hands of the user.

Various modifications will become possible for those skilled in the art after receiving the teachings of the present disclosure without departing from the scope thereof.

What is claimed is:

1. A toner supplying apparatus comprising:

a storage container for storing toner;

a tray fastened to the storage container;

suction means for suctioning air within the storage container; and a shutter member;

wherein the storage container has a toner discharge opening for discharging toner; a toner inflow opening for allowing toner to flow into a developer vessel is provided in the tray; the shutter member carries out opening and closing of the toner inflow opening; and when volume reduction of the storage container is carried out, the toner inflow opening is closed by the shutter member and air within the storage container is suctioned from the toner discharge opening by the suction means.

2. The toner supplying apparatus as claimed in claim 1, wherein the suction means is provided with a cylinder linked to the storage container, a piston that moves freely slidably between one end side and another end side inside the cylinder, and a pump for suctioning air within the cylinder; the shutter member is connected to the piston; the piston is formed with an air hole one end of which opens toward the inside of the cylinder and the other end of which opens to an inside surface side of the cylinder; a linking hole that links to the toner discharge opening is formed at a side surface of the other end side of the cylinder; the piston is pushed from the one end side to the other end side and the shutter member moves in conjunction with the piston when air is sent into the cylinder by driving the pump such that the toner inflow opening closes and the air hole of the piston and the linking hole of the cylinder link; and air inside the storage container is suctioned through the air hole of the piston when air inside the cylinder is suctioned.

3. The toner supplying apparatus as claimed in claim 2, wherein the pump is provided with an air supply opening and a discharge opening; a switching valve is provided between the pump and the cylinder; and when the cylinder is connected to the air supply opening and air is fed into the cylinder, the piston is pushed from the one end side to the other end side such that the shutter member moves and closes the toner inflow opening, and when the cylinder is connected to the discharge opening due to a switching of the switching valve and air within the cylinder is suctioned, air within the storage container is suctioned through the air hole of the piston.

4. The toner supplying apparatus as claimed in claim 3, wherein detection sensors for detecting presence/absence of the piston are provided at a side surface of one end side and a side surface of another end side of the cylinder, and when the detection sensor of the side surface of the other end side of the cylinder has detected the piston, the switching valve switches such that the cylinder is connected to the discharge opening and air inside the cylinder is suctioned, and when the detection sensor of the side surface of the one end side of the cylinder has detected the piston, driving of the pump is stopped such that the storage container can be removed from the tray.

5. The toner supplying apparatus as claimed in claim 3, wherein the toner supplying apparatus is provided in a plurality; each of the toner supplying apparatuses has a switching valve; headers are provided at the pump; and the header provided at the air supply opening of the pump is connected to each of the switching valves and the header provided at the discharge opening of the pump is connected to each of the switching valves.

6. The toner supplying apparatus as claimed in claim 2, wherein when air is suctioned from within the cylinder so that a container is reduced in volume and thereafter air is further suctioned from within the cylinder, the inside of the cylinder is decompressed and the piston returns from the other end side to the one end side, and the shutter member moves so that the toner inflow opening opens and the storage container can be removed from the tray.

7. A volume reducing apparatus, comprising:

a housing portion in which an item to be housed is housed;

a shutter member;

a cylinder linked to the housing portion;

a piston freely movable inside the cylinder; and a medium discharge portion that links to the cylinder and discharges a medium into the cylinder;

wherein an opening portion that links to the outside is formed at the housing portion, a linking hole that links inside the cylinder and the opening portion is formed at the cylinder, and the piston has an air hole that links to the linking hole at another end side inside the cylinder, and the piston moves from one end side to the other end side inside the cylinder when a medium is discharged from the medium discharge portion into the cylinder such that the air hole of the piston and the linking hole of the cylinder link and the medium is discharged into the housing portion and the opening portion of the housing portion is closed by the shutter member.

8. A volume reducing apparatus, comprising:

a housing portion in which an item to be housed is housed;

a shutter member;

a cylinder linked to the housing portion;

a piston freely movable inside the cylinder; and a medium suction portion that links to the cylinder and suctions a medium inside the cylinder;

wherein an opening portion that links to the outside is formed at the housing portion, a linking hole that links inside the cylinder and the opening portion is formed at the cylinder, and the piston has an air hole that links to the linking hole at another end side inside the cylinder, and the piston moves from the other end side to one end side inside the cylinder when a medium inside the cylinder is suctioned via the medium suction portion such that a linkage between the linking hole of the cylinder and the air hole of the piston closes and the shutter member moves such that the opening portion of the housing portion opens.

9. A volume reducing apparatus, comprising:

a housing portion in which an item to be housed is housed;

a shutter member;

a cylinder linked to the housing portion;

a piston freely movable inside the cylinder;

a medium discharge portion that links to the cylinder and discharges a medium into the cylinder; and a medium suction portion that links to the cylinder and suctions a medium inside the cylinder, wherein an opening portion that links to the outside is formed at the housing portion, a linking hole that links inside the cylinder and the opening portion is formed at the cylinder, and the piston has an air hole that links to the linking hole at another end side inside the cylinder, and the piston moves to the other end side inside the cylinder when a medium is discharged from the medium discharge portion into the cylinder such that the air hole of the piston and the linking hole of the cylinder link and the medium is discharged into the housing portion and the opening portion of the housing portion is closed by the shutter member, and the piston moves from the other end side to one end side inside the cylinder when a medium inside the cylinder is suctioned via the medium suction portion such that a linkage between the linking hole of the cylinder and the air hole of the piston closes and the shutter member moves such that the opening portion of the housing portion opens.

10. The volume reducing apparatus as claimed in claim 9, further comprising;

a switching device provided between the medium discharge portion/the medium suction portion and the cylinder, wherein a medium discharge passageway constituting a passageway for a medium discharged from the medium discharge portion into the cylinder and a medium suction passageway constituting a passageway for the medium suctioned from inside the cylinder to the medium suction portion are formed at the switching device, wherein the medium discharge passageway and the medium discharge portion as well as the medium discharge passageway and the cylinder respectively link when the switching device switches in one direction such that the medium is discharged from the medium discharge portion into the cylinder, and the medium suction passageway and the medium suction portion as well as the medium suction passageway and the cylinder respectively link when the switching device switches in another direction such that the medium is suctioned from inside the cylinder to the medium suction portion.

11. The volume reducing apparatus as claimed in claim 10, wherein the switching device is a cylindrical rotational structure; a magnetic member that protrudes outward from an outer periphery side surface and an elastic member having a biasing force in a rotational direction are provided at the rotational structure; an electromagnet on one side and an electromagnet on another side that produce magnetic force using electricity are provided respectively in opposing positions sandwiching the magnetic member; when there is no electric current flowing in the electromagnet on the one side and the electromagnet on the other side, the rotational structure is in a predetermined position; when an electric current is supplied to the electromagnet on the one side, the magnetic member is attracted to the electromagnet on the one side and the rotational structure rotates in one direction; and when an electric current is supplied to the electromagnet on the other side, the magnetic member is attracted to the electromagnet on the other side and the rotational structure rotates in another direction.

12. The volume reducing apparatus as claimed in claim 9, wherein the volume reducing apparatus is provided in a plurality, each of the volume reducing apparatuses has a switching device, and a plurality of linking members are provided between the medium suction portion and the switching device, and between the medium discharge portion and the switching device.

* * * * *